US011222758B2

(12) United States Patent
Soldan et al.

(10) Patent No.: US 11,222,758 B2
(45) Date of Patent: Jan. 11, 2022

(54) ROTARY HANDLE CONSTRUCTION OF AN ELECTRICAL SWITCH

(71) Applicant: ABB Schweiz AG, Baden (CH)

(72) Inventors: Juha Soldan, Vaasa (FI); Matti Knuuttila, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 16/879,036

(22) Filed: May 20, 2020

(65) Prior Publication Data

US 2020/0279702 A1 Sep. 3, 2020

Related U.S. Application Data

(63) Continuation of application No. PCT/FI2018/050846, filed on Nov. 21, 2018.

(51) Int. Cl.

| | |
|---|---|
| ***H01H 19/14*** | (2006.01) |
| ***H01H 9/22*** | (2006.01) |
| ***H01H 19/03*** | (2006.01) |

(52) U.S. Cl.

CPC ..... *H01H 19/14* (2013.01); *H01H 9/22* (2013.01); *H01H 19/03* (2013.01)

(58) Field of Classification Search

CPC .. H01H 9/22; H01H 9/26; H01H 9/20; H01H 9/28; H01H 19/03; H01H 19/14; H01H 9/24

See application file for complete search history.

(56) References Cited

U.S. PATENT DOCUMENTS 4,612,424 A 9/1986 Clark et al.
5,669,489 A * 9/1997 von Ende ..... G01D 5/25 200/11 R (Continued)

FOREIGN PATENT DOCUMENTS

DE 4439374 C1 2/1996
EP 2393092 A1 12/2011

(Continued)

OTHER PUBLICATIONS

Finnish Patent Office, International Search Report & Written Opinion issued in corresponding Application No. PCT/FI2018/050846, dated Feb. 28, 2019, 20 pp.

(Continued)

*Primary Examiner* — Ahmed M Saeed
(74) *Attorney, Agent, or Firm* — Leydig, Voit & Mayer, Ltd.

(57) ABSTRACT

The construction comprises a rotary handle with a first pivot axis, a locking latch with a second pivot axis, a fixed bottom ring, a locking pin movable with the locking latch between a first position in which the rotary handle can be turned in relation to the bottom ring and a second position in which the locking pin prevents turning of the rotary handle in relation to the bottom ring, a shaft adapter rotationally movable against a spring force in relation to the rotary handle. The shaft adapter comprises a protrusion having a locking member which locks the locking pin into the first position when the torsional moment acting on the rotary handle exceeds the spring force acting on the shaft adapter causing a limited rotational movement of the shaft adapter in relation to the rotary handle.

18 Claims, 7 Drawing Sheets

(56) References Cited

U.S. PATENT DOCUMENTS

Figure 1:
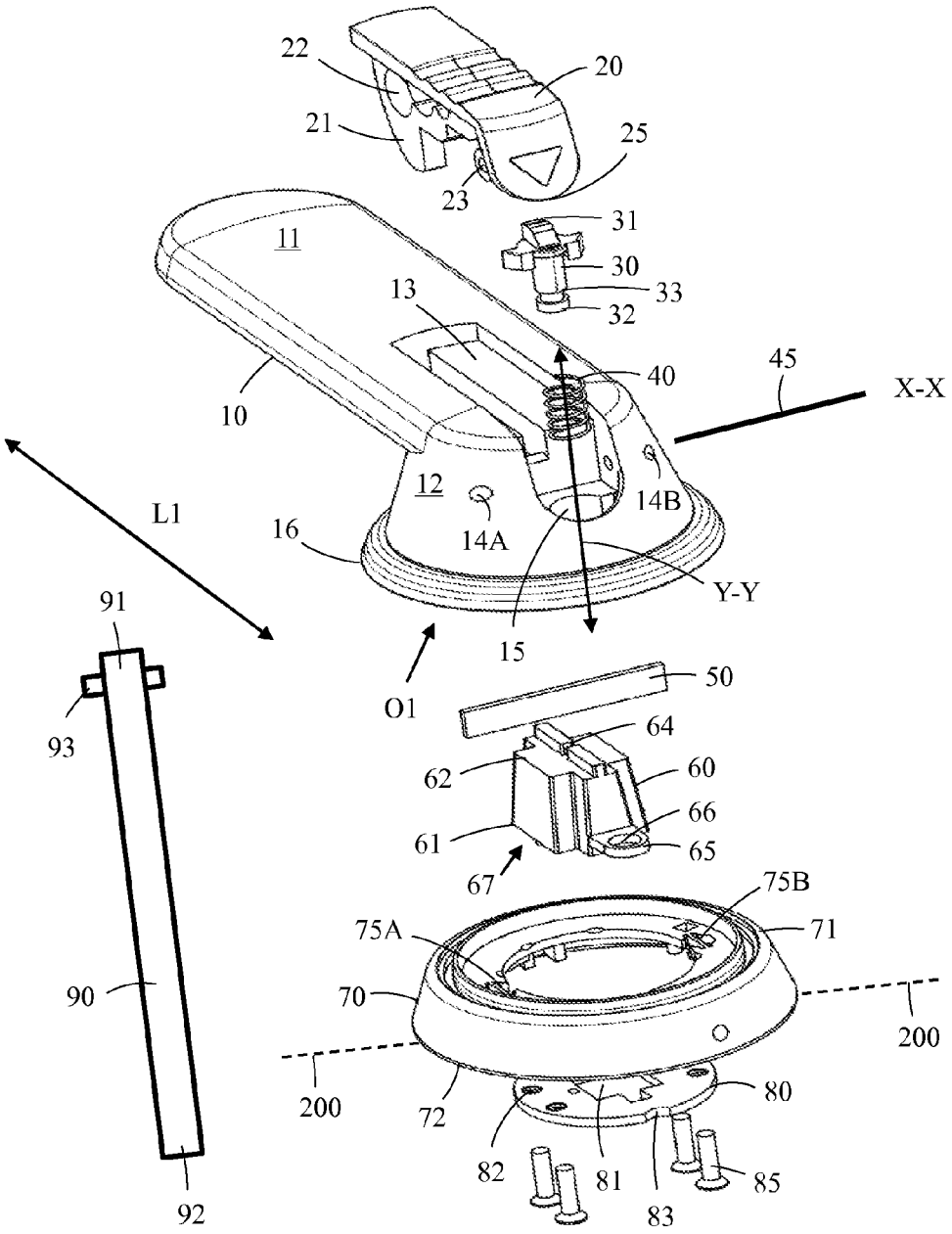

| | | | | |
|---|---|---|---|---|
| 5,998,743 | A | 12/1999 | Unkel | |
| 6,423,912 | B1 * | 7/2002 | Arenz | H01H 9/282 200/336 |
| 2005/0167255 | A1 * | 8/2005 | Howie | H01H 19/03 200/336 |
| 2005/0230229 | A1 * | 10/2005 | Kurek | H01H 19/03 200/6 R |
| 2006/0278505 | A1 | 12/2006 | Low et al. | |
| 2011/0181378 | A1 * | 7/2011 | Yamada | H01H 19/03 334/88 |
| 2015/0221458 | A1 | 8/2015 | Oneufer et al. | |

FOREIGN PATENT DOCUMENTS

| | | | |
|---|---|---|---|
| FR | 3029680 | A1 | 6/2016 |
| WO | 2011012806 | A1 | 2/2011 |
| WO | 2014146586 | A1 | 9/2014 |

OTHER PUBLICATIONS

European Patent Office, Extended Search Report issued in corresponding Application No. 18880321.7, dated Nov. 17, 2020, 8 pp.

* cited by examiner

A-A

B-B

ROTARY HANDLE CONSTRUCTION OF AN ELECTRICAL SWITCH

FIELD

The invention relates to a rotary handle construction of an electrical switch.

BACKGROUND

A switch is an apparatus used for opening and closing of an electric circuit. A switching device may comprise a least one pole operated by a drive device. At least one movable contact may be adapted in the pole, which opens and closes a connection between fixed contacts.

A switching device may be operated with a rotary handle. The rotary handle may be turned between a 0-position in which the switching device opens the electrical circuit and an I-position in which the switching device closes the electrical circuit. The rotary handle may be connected through a drive shaft to the pole of the switching device.

The switching device must be provided with a reliable position indicator and it must further be possible to lock the rotary handle of the switching device in the open-position. The open position is the position in which the switch opens the electric circuit.

Standards relating to switches require further that it must be prevented to lock the switch in the open-position in a situation in which any of the contacts of the switch is not open. In a situation in which at least one of the contacts of the switch is sticking and the rotary handle is turned by force to the 0-position, it must be prevented to lock the rotary handle into this 0-position.

FR patent application 3029680 discloses a solution comprising a rotary handle, a locking latch integrated into the rotary handle, a locking pin, a connection piece, as well as a bottom ring. The rotary handle may be turned between an open-position and a closed-position. The locking latch is attached with an articulated joint to the rotary handle so that the locking latch may be turned around the articulated joint between the locking position and the release position. In the locking position of the locking latch the rotary handle is locked into an open position, whereby the rotary handle cannot be turned into the closed-position. The locking latch operates the locking pin so that in the locking position of the locking latch the locking pin protrudes into an opening in a non-rotatable bottom ring, whereby the rotary handle is locked into the open-position. In a situation in which at least one contact is sticking, a great counter moment is acting on the rotary handle when one tries to turn the rotary handle into an open-position. This counter moment produces a rotation of the connection part in the circumferential direction in relation to the rotary handle, whereby a protrusion in the connection part sets partly in front of the opening in the bottom part, whereby protrusion of the locking pin into said opening is prevented.

SUMMARY

The object of the invention is an improved rotary handle construction of an electrical switch.

The rotary handle construction of an electrical switch according to the invention is defined in claim 1.

The rotary handle construction of the electrical switch comprises:

a rotary handle being turnable around a first pivot axis between at least an open- and a closed-position, a locking latch being adapted in a first space formed into the rotary handle and being turnable around a second pivot axis between a locked position and a released position, a bottom ring being fixed in relation to the rotary handle, a locking pin also being adapted into the first space in the rotary handle and being movable in the longitudinal direction with the turning latch between a first position and a second position, in which first position the locking pin is at a distance from the bottom ring allowing turning of the rotary handle in relation to the bottom ring and in which second position the locking pin protrudes into a first opening in the bottom ring preventing turning of the rotary handle in relation to the bottom ring, a shaft adapter being adapted with a play in a nest formed in the rotary handle and receiving an operational shaft leading from the rotary handle to the electrical switch, whereby the play in the nest permits a restricted rotational movement of the shaft adapter against a spring force in relation to the rotary handle.

The rotary handle construction is characterized in that the shaft adapter comprises a protrusion having a locking member which locks the locking pin into the first position in a situation in which the torsional moment acting on the rotary handle exceeds the spring force acting on the shaft adapter causing a limited rotational movement of the shaft adapter in relation to the rotary handle.

The invention makes it possible to reliably prevent locking of the rotary handle into the open-position in a situation in which at least one of the contacts of the electrical switch is sticking. It is not possible to lift up the locking latch from the rotary handle in such a situation as the locking pin is locked in its first position. Due to the fact that it is not possible to lift up the locking latch in such a situation, it is also not possible to attach a padlock to the rotary handle in order to lock the rotary handle into an upper position. The requirements of the standards are thus satisfied.

DRAWINGS

Figure 2:
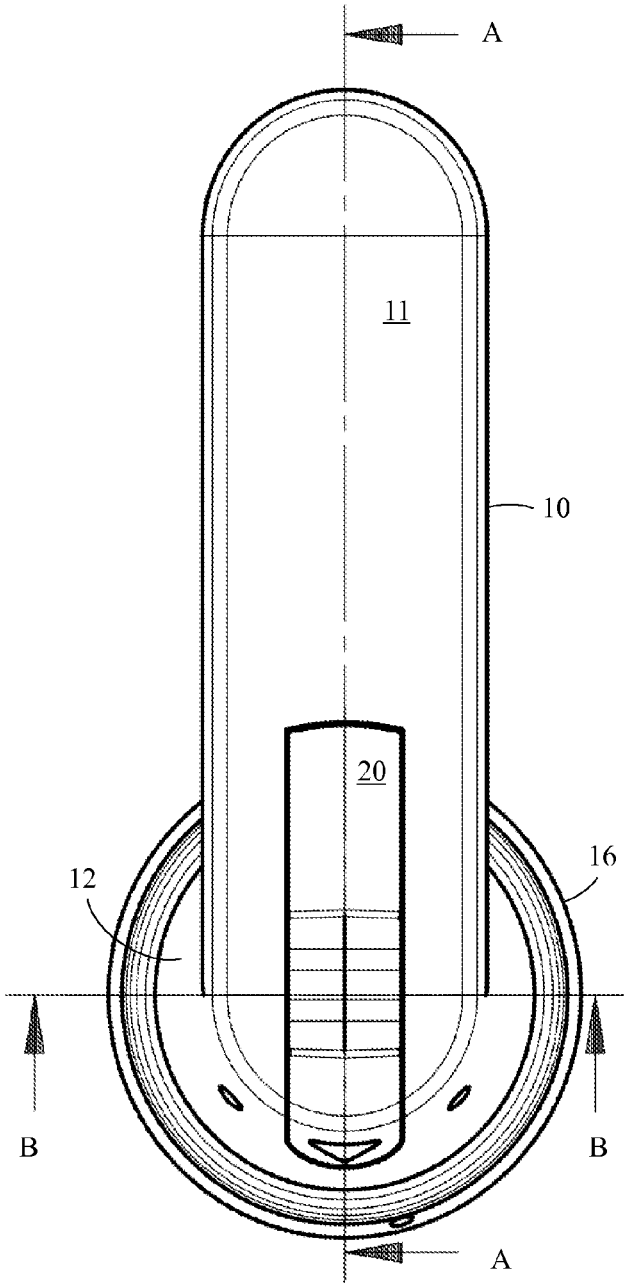
Figure 3:
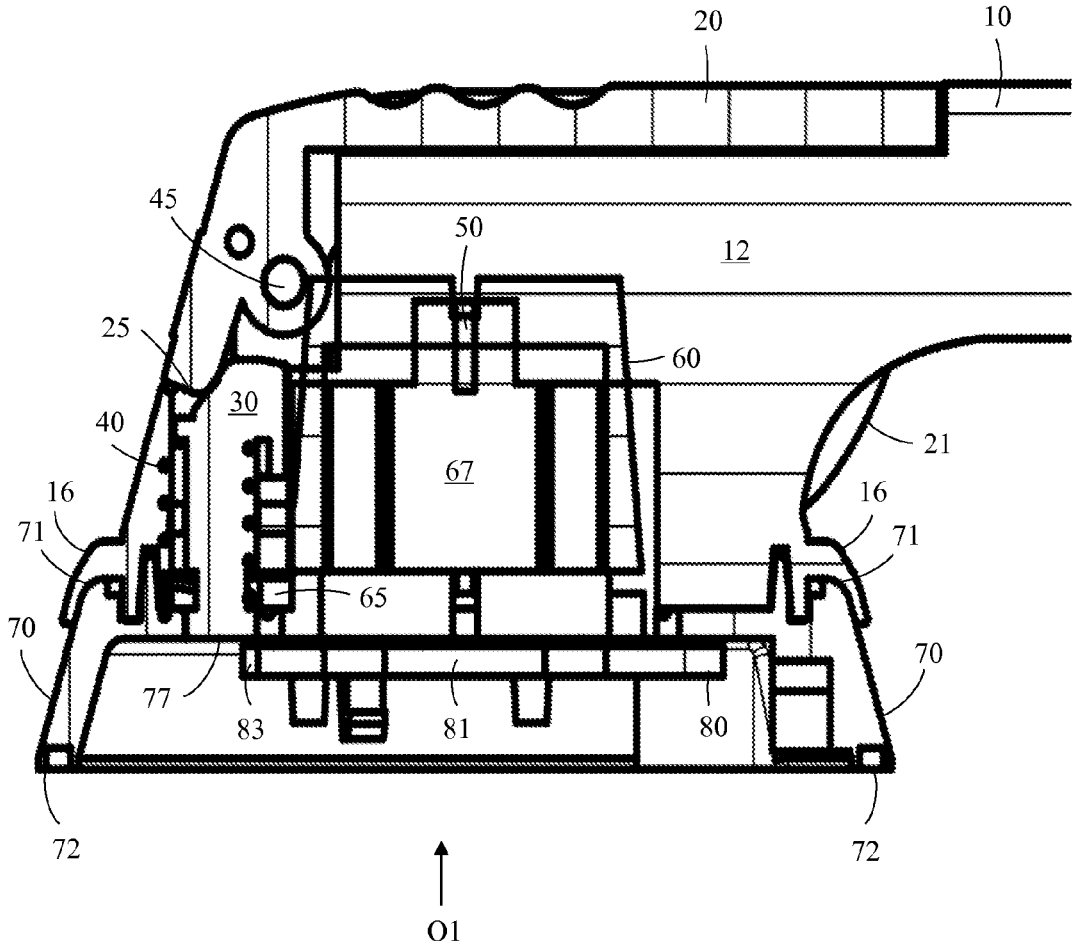
Figure 4:
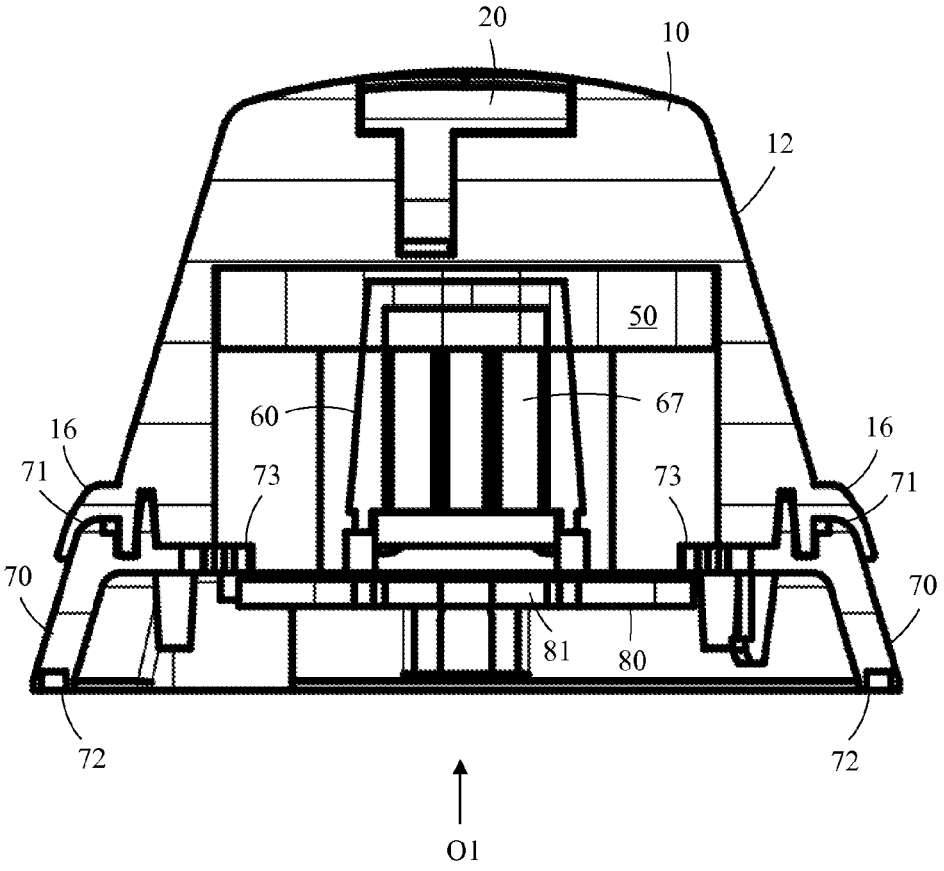
Figure 5:
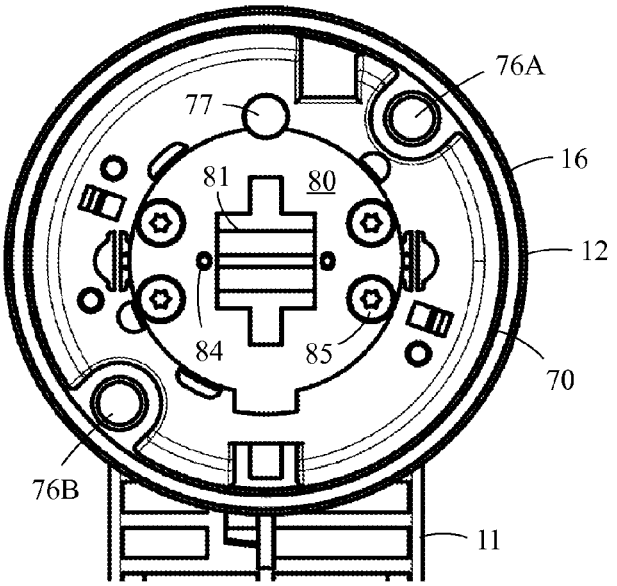
Figure 6:
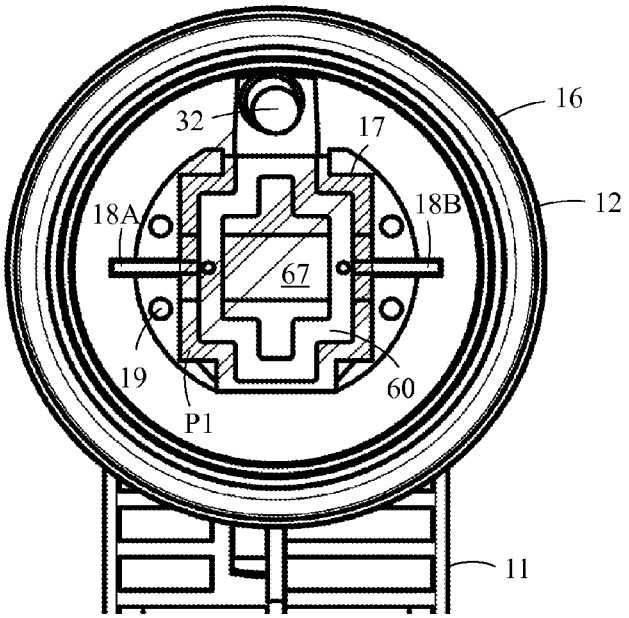
Figure 7:
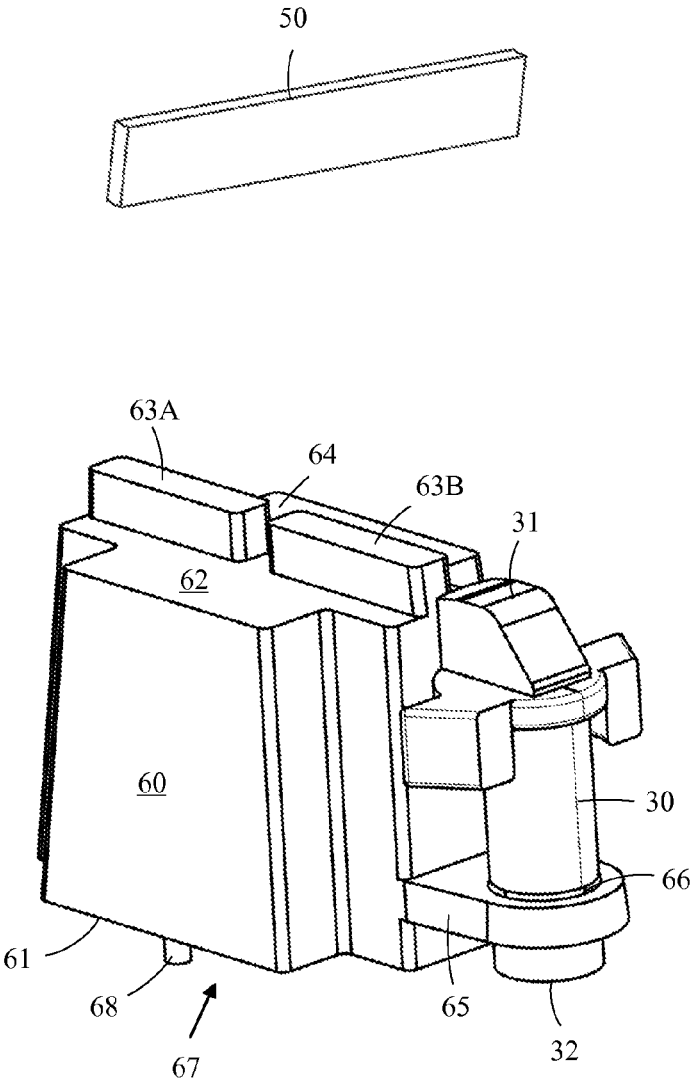
Figure 8:
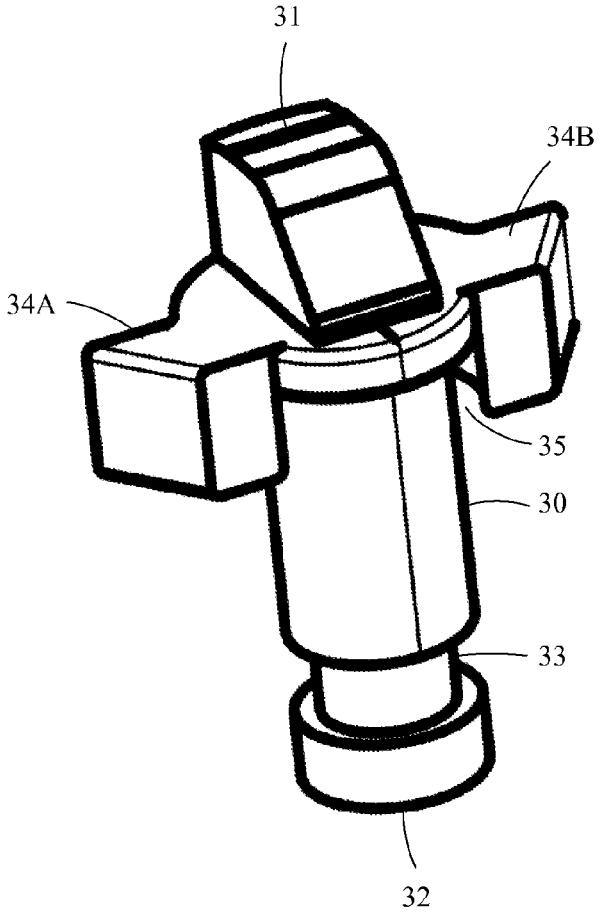

The invention is in the following described with reference to the enclosed figures in which FIG. 1 presents an exploded view of a rotary handle construction of an electrical switch, FIG. 2 presents the rotary handle construction from above, FIG. 3 presents a longitudinal cross section of an end portion of the rotary handle construction, FIG. 4 presents a transverse cross section of the end portion of the rotary handle construction, FIG. 5 presents the end portion of the rotary handle construction from the bottom, FIG. 6 presents the end portion of the rotary handle construction from the bottom when the bottom ring and the bottom plate is removed, FIG. 7 presents the shaft adapter, the locking pin and the leaf spring of the rotary handle construction, FIG. 8 presents the locking pin of the rotary handle construction.

DETAILED DESCRIPTION

FIG. 1 presents an exploded view of a rotary handle construction of an electrical switch.

The rotary handle construction comprises a rotary handle 10, a locking latch 20, a locking pin 30, a return spring 40, a torsion spring 50, a shaft adapter 60, a bottom ring 70, a bottom plate 80 as well as fastening screws 85. The rotary handle construction includes further a drive shaft 90 via which the rotary handle 10 is connected to the electrical switch. The electrical switch is not shown in the figures.

The rotary handle 10 is formed of a gripping portion 11 and an end portion 12. The gripping portion 11 may be formed of a longitudinal piece. The cross section of the gripping portion 11 may be substantially rectangular. The end portion 12 may be substantially annular. The rotary handle 10 is further provided with a longitudinal first space 13 which extends from the gripping portion 11 to the end portion 12. The first space 13 receives the locking latch 20. The longitudinal direction L1 of the rotary handle 10 extends in the longitudinal direction of the gripping portion 11. The rotary handle 10 is turnable around a first pivot shaft Y-Y at least between an open- and a closed-position. The end portion 12 in the rotary handle 10 is provided with an opening O1 from which access to an interior of the end portion 12 of the rotary handle 10 is provided. The opening O1 is surrounded by a collar 16 which may be substantially annular.

The locking latch 20 is adapted into the first space 13 in the rotary handle 10 so that the locking latch 20 is attached via an articulated joint to the rotary handle 10. The locking latch 20 is provided with a transverse hole 23 and the end portion 12 of the rotary handle 10 is provided with transverse holes 14A, 14B. The first hole 14A extends from an outer surface of the end portion 12 to the first space 13 and the second hole 14B extends from an opposite outer surface of the end portion 12 into the first space 13. The first hole 14A and the second hole 14B are concentric. When the locking latch 20 is positioned in the first space 13, a pivot shaft 45 may be pushed through the holes 14A, 14B in the end portion 12 of the rotary handle 10 and through a hole 23 in the locking latch 20. The pivot shaft 45 forms thus a pivot for the locking latch 20. The locking latch 20 extends in the longitudinal direction L1 of the rotary handle 10. The locking latch 20 may be turned around a second pivot axis X-X formed by the pivot shaft 45 between a locking-position and a released-position. The second pivot axis X-X may extend in a transverse direction of the rotary handle 10. The second pivot axis X-X may extend in a 90 degree angle in relation to the first pivot axis Y-Y.

The locking latch 20 may further comprise a protruding portion 21 which extends downwards in the locking latch 20. This protruding portion 21 comprises an opening 22 extending through the protruding portion 21 in the transverse direction of the locking latch 20. The locking latch 20 forms in the locking-position an angle with the longitudinal L1 direction of the rotary handle 10, whereby the opening 22 of the protruded portion 21 is situated above the upper surface of the gripping portion 11 of the rotary handle 10. The locking latch 20 is in the released-position directed along the longitudinal direction L1 of the rotary handle 10. In the locking-position of the locking latch 20, one or several padlocks may be mounted in the opening 22 in the protruding portion 21 of the locking latch 20, whereby the padlock or the padlocks prevent turning of the locking latch 20 into the released-position. The protruded portion 21 of the locking latch 20 extends through the gripping portion 11 of the rotary handle 10 so that the protruded portion 21 protrudes from an inner surface of the gripping portion 11. The locking latch 20 is provided with an end surface 25 which comes into contact with the locking pin 30.

The locking pin 30 is adapted in the first space 13 in the rotary handle 10 i.e. in a hole 15 formed in the end portion 12 of the rotary handle 10, said hole 15 being provided in the first space 13. The hole 15 extends substantially in the direction of the first pivot shaft Y-Y through the end portion 12 of the rotary handle 10. The locking pin 30 may move in the longitudinal direction of the locking pin 30 in the hole 15. The licking pin 30 comprises a first end 31 and a second opposite end 32. The first end 31 of the locking pin 30 comes into contact with the end surface 25 of the locking latch 20. When the locking latch 20 is lifted upwards from the rotary handle 10, the locking latch 20 turns around the second pivot shaft X-X, whereby the end surface 25 of the locking latch 20 presses the locking pin 30 downwards.

A return spring 40 is arranged in connection with the locking pin 30. The return spring 40 may be formed of a coil spring which has been adapted around the locking pin 30. The hole 15 may be formed of two axially successive portions. The diameter of an upper portion of the hole 15 may be adapted according to an outer diameter of the coil spring 40 and the diameter of a lower portion of the hole 15 may be adapted according to an outer diameter of the locking pin 30. The coil spring 40 is thus compressed when the end surface 25 of the locking latch 20 moves the locking pin 30 against the locking-position. The coil spring 40 returns the locking pin 30 into a released position when no external force is acting on the locking pin 30 i.e. when the locking latch 20 is released. The locking pin 30 is thus supported in the hole 15 when the locking pin 30 moves in the longitudinal direction of the locking pin 30.

The torsion spring 50 may be formed of a leaf spring, which has been adapted from its ends to grooves in the end portion 12 of the rotary handle 10. The torsion spring 50 is thus supported only from its ends to the end portion 12 of the rotary handle 10. A middle portion of the torsion spring 50 remains thus free.

The shaft adapter 60 comprises an upper surface 61 and a bottom surface 62. The shaft adapter 60 is adapted with a play into a nest in the end portion 12 of the rotary handle 10. The play of the shaft adapter 60 in the nest makes it possible for the shaft adapter 60 to rotate a limited amount in both directions in relation to the rotary handle 10. The shaft adapter 60 comprises a groove 64 in the bottom of the shaft adapter 60, into which the middle portion of the torsion spring 50 may settle. The shaft adapter 60 comprises further a protrusion 65 provided with an opening 66 passing through the protrusion 65. The opening 66 forms a locking member. The opening 66 may be formed of a round hole, with a closed edge, whereby the locking pin 30 passes through the hole. The opening 66 may on the other hand be formed of a round hole having an at least partly open perimeter. The protrusion 65 may thus be sawn across the hole 66 so that a slit is formed from the outer surface of the protrusion 65 to the hole 66. The protrusion 65 may also have the form of a fork. The protrusion 65 may be planar. The form of the cross section of the opening 66 is determined by the form of the cross section of the locking pin 30. A cavity 67 is formed inside the shaft adapter 60, the cavity 67 receiving a first end 91 of the drive shaft 90.

The bottom ring 70 may be fixedly attached with fastening screws 75A, 75B to the fastening surface 200 into which the rotary handle 10 is to be installed. The fastening surface 200 may be formed of a door or sheet in a cubicle. The collar 16 surrounding the opening O1 in the end portion 12 of the rotary handle 10 settles against a first end surface 71 of the bottom ring 70. A second end surface 72 of the bottom ring 70 settles against the fastening surface 200. The bottom ring 70 is thus fixed in relation to the rotary handle 10 i.e. the rotary handle 10 turns around the first pivot shaft Y-Y in relation to the bottom ring 70.

The bottom plate 80 acts as a fastening means between the rotary handle 10 and the bottom ring 70. A cross section of the bottom plate 80 may be substantially round. The bottom plate 80 may be attached with fastening screws 85 to the end portion 12 of the rotary handle 10. An outer edge of the bottom plate 80 settles against a support surface within the bottom ring 70 so that the bottom plate 80 may rotate with the rotary handle 10 in relation to the bottom ring 70. The bottom plate 80 comprises a shaft opening 81 in the middle portion of the bottom plate 80, the form of the cross section of the opening 81 corresponding substantially to the form of the cross section of the drive shaft 90. The drive shaft 90 is adapted with a play into the shaft opening 81 in the bottom plate 80 so that the drive shaft 90 may turn a little bit in both directions around the longitudinal axis of the drive shaft 90 in relation to the bottom plate 80. A cavity 83 is provided in an outer circumference of the bottom plate 80, said cavity 83 receiving a second end 32 of the locking pin 30 when the locking pin 30 is in the locking-position. The bottom plate 80 is further provided with fastening openings 82 through which the fastening screws 85 may be conducted.

The drive shaft 90 connects the rotary handle 10 to the control shaft of the electrical switch. Turning of the rotary handle 10 turns thus, via the drive shaft 90, the control shaft provided in the electrical switch. The control shaft may be connected to power transmission elements and working springs in the electrical switch, the working springs acting on the movable contacts of the electrical switch. The drive shaft 90 extends through the bottom plate 80 so that a first end 91 of the drive shaft 90 sets into the shaft adapter 60 and a second end 92 of the drive shaft 90 sets into the control shaft of the electrical switch. The form of a cross section of the drive shaft 90 may be substantially rectangular. The first end 91 of the drive shaft 90 may further comprise a transverse directed shaft pin 93.

FIG. 2 presents the rotary handle construction from above.

The figure shows that the gripping portion 11 of the rotary handle 10 is formed of a longitudinal substantially rectangular piece having a rounded outer end. The end portion 12 of the rotary handle 10 is formed of a substantially round piece having a collar 16. The locking latch 20 is formed of a longitudinal piece which is seated in the first space 13 formed in the rotary handle 10.

FIG. 3 presents a longitudinal cross section of an end portion of the rotary handle construction. The cross section is taken along the longitudinal cross section plane A-A shown in FIG. 2.

The bottom ring 70 is connected from its upper end 71 to the collar 16 in the end portion 12 of the rotary handle 10. The locking latch 20, the pivot shaft 45 of the locking latch 20, the protrusion 21 of the locking latch 20, the end portion 25 of the locking latch 20, the locking pin 30 and the coil spring 40 around the locking pin 30 is adapted into the rotary handle 10. The leaf spring 50 keeps the shaft adapter 60 in place in the rotational direction. The upper end 71 of the bottom ring 70 is adapted into the collar 16 of the end portion 12 and an opening O1 is provided in the lower end 72 of the bottom ring 70, through which opening O1 the bottom plate 80 may be pushed on the end portion 12. A first opening 77 is provided in the bottom ring 70, into which first opening 77 the lower end 32 of the locking pin 30 seats when the locking pin 30 is in the lower position. The bottom plate 80 comprises a shaft opening 81 and a cavity 83 is provided on an outer circumference of the bottom plate 80, into which cavity 83 the lower end 32 of the locking pin 30 seats when the locking pin 30 is in the lower position. The locking pin 30 locks, in the locking position, the rotary handle 10 and the bottom plate 80 to the bottom ring 70. The shaft adapter 60 is provided with a cavity 67 receiving the upper end 91 of the drive shaft 90.

The locking pin 30 is thus movable in its longitudinal direction with the locking latch 20 between the first and the second position. The locking pin 30 is in the first position at a distance from the bottom ring 70 allowing turning of the rotary handle 10 in relation to the bottom ring 70. The locking pin 30 protrudes, in the second position, into the first opening 77 in the bottom plate 70 preventing turning of the rotary handle 10 in relation to the bottom ring 70.

The locking pin 30 is in the first position in the figure, whereby the rotary handle 10 may turn in relation to the bottom ring 70. The locking pin 30 is, in the first position, in the upper position which also is the release position.

The outer end 65 of the shaft adapter 60 is, in this first position of the locking pin 30, at the groove 33 of the locking pin 30.

FIG. 4 presents a transverse cross section of the end portion of the rotary handle construction. The cross section is taken along the transverse cross section plane B-B shown in FIG. 2.

The bottom ring 70 is connected from its upper end 71 to the collar 16 of the end portion 12 of the rotary handle 10. The locking latch 20 is adapted into the rotary handle 10. The leaf spring 50 keeps the shaft adapter 60 stationary in the rotational direction. The upper end 71 of the bottom ring 70 is adapted to the collar 16 in the end portion 12 and the lower end 72 of the bottom ring 70 is provided with an opening O1 through which the bottom plate 80 may be pushed into the end portion 12. The bottom plate 80 is provided with a shaft opening 81. The shaft adapter 60 is provided with a cavity 67, which receives the upper end 91 of the drive shaft 90. The bottom ring 70 comprises a support surface 73 against which the bottom plate 80 seats. The bottom plate 80 may turn in relation to the bottom ring 70 along the support surface 73 of the bottom ring 70.

FIG. 5 presents the end portion of the rotary handle construction from the bottom.

The bottom ring 70 and the bottom plate 80 with the shaft opening 81 is seen in the end portion 12 of the rotary handle 10. There are further openings 84 at both sides of the shaft opening 81, said openings 84 receiving the pins 68 in the shaft adapter 60. The openings 84 may be oblong so that they prevent movement of the shaft adapter in the side direction, but allow rotation of the shaft adapter 60. The bottom ring 70 comprises an opening 77 into which a lower end 32 of the locking pin 30 seats in the locking position. The bottom ring 70 is provided with fastening openings 76A, 76B, through which the fastening screws 75A, 75B extend when the bottom ring 70 is attached to the fastening surface 200.

FIG. 6 presents the end portion of the rotary handle construction from the bottom when the bottom ring and the bottom plate is removed.

The shaft adapter 60, the cavity 67 formed into the shaft adapter 60, which cavity 67 receives the first end 91 of the drive shaft 90 is shown in the end portion 12 of the rotary handle 10. The end portion 12 of the rotary handle 10 comprises also fastening slots 18A, 18B into which the ends of the leaf spring 50 seats. The shaft adapter 60 is adapted with a play P1 into the nest 17 in the end portion 12 of the rotary handle 10. The end portion 12 of the rotary handle 10 comprises fastening openings 19 into which fastening screws 85 of the bottom plate 80 settle when the bottom plate 80 is seated into the end portion 12. The shaft adapter 60 is provided with a cavity 67 receiving the upper end 91 of the drive shaft 90.

FIG. 7 presents the shaft adapter, the locking pin and the leaf spring of the rotary handle construction.

The shaft adapter 60 is formed of a piece with a polygonal cross section having an end surface 61 and a bottom surface 62. A longitudinal direction of the shaft adapter 60 is formed of a line passing in a perpendicular direction through the end surface 61 and the bottom surface 62. The bottom surface 62 is closed. The bottom surface 61 of the shaft adapter 60 comprises two parallel over the bottom surface extending protrusions 63A, 63B. A groove 64 is formed between the protrusions 63A, 63B at the middle of the bottom surface 62 of the shaft adapter 60, said groove 64 receiving the middle portion of the leaf spring 50. The shaft adapter 60 comprises further in one side surface a protrusion 65 having an opening 66 passing through the protrusion 65, the opening 66 receiving the second end 32 of the locking pin 30. The opening 66 may be provided with a closed edge as shown in the figure or the opening 66 may be provided with an at least partly open edge. Instead of the opening 66 the protrusion 65 could be provided a fork or the protrusion could be formed of a fork. Rotation of the shaft adapter 60 around the longitudinal axis of the shaft adapter in either direction would move either fork into the groove 33 of the locking pin 30, whereby the locking pin 30 would be locked to the shaft adapter 60. A cavity 67 has been formed into the shaft adapter 60, said cavity 67 opening into the end surface 61 of the shaft adapter 60. The cavity 67 of the shaft adapter 60 receives the upper end 91 of the drive shaft 90. The bottom surface 62 of the shaft adapter 60 is closed.

The shaft adapter 60 comprises further pins 68 which settle into openings 84 provided on both sides of the shaft opening 81 in the bottom plate 80. The openings 84 may be oval so that they prevent sideways movement of the shaft adapter 60 but allow rotation of the shaft adapter 60.

The ends of the torsion spring 50 are seated in grooves 18A, 18B provided in the end portion 12 of the rotary handle 10, whereby the torsion spring 50 keeps the shaft adapter 60 in position in view of rotation of the shaft adapter 60. The torsion spring 50 opposes the rotation of the shaft adapter 60 around its longitudinal axis. As the shaft adapter 60 is adapted with a play P1 into the nest 17 in the end portion 12 in the rotary handle 10, the shaft adapter 60 may rotate slightly around its longitudinal axis in relation to the rotary handle 10.

The cross section of the shaft adapter 60 forms a polygonal. The shaft adapter 60 is conical so that the cross section of the shaft adapter 60 contracts when moving from the end surface 61 towards the bottom surface 62.

FIG. 8 presents the locking pin of the rotary handle construction.

The locking pin 30 comprises a first end 31 and a second end 32. The lower portion of the locking pin 30 is substantially cylindrical. The locking pin 30 is provided with a groove 33 at a distance from the second end 32 of the locking pin 30. There are protrusions 34A, 34B in connection with the first end 31 of the locking pin 30, said protrusions 34A, 34B working as guiding surfaces when the locking pin 30 moves in its longitudinal direction in the opening 15 in the end portion 12 of the rotary handle 10. The cross section of the opening 15 corresponds to the cross section of the locking pin 30 at the protrusions 34A, 34B. The first end 31 of the locking pin 30 receives the end surface 25 of the locking latch 20, whereby the end surface 25 presses the locking pin 30 downwards when the locking latch 20 is raised upwards. The protrusions 34A, 34B form a kind of collar 35 which receives the upper end of the coil spring 40. The lower portion of the locking pin 30 may be substantially cylindrical. The cross section of the lower portion of the locking pin 30 may on the other hand, instead of having a round form, have any form e.g. it may be oval, rectangular or polygonal.

When the end surface 25 of the locking latch 20 presses the locking pin 30 downwards, the coil spring 40 around the locking pin 30 will be compressed. When the locking latch 20 is released, the locking latch 20 will return to its open-position due to the pushing force produced by the coil spring 40.

The invention and the embodiments of the invention are not restricted to the examples shown in the figures. The invention may thus vary within the scope of protection afforded by the claims.

The invention claimed is:

1. A rotary handle construction of an electrical switch comprises:

a rotary handle being turnable around a first pivot axis between at least an open- and a closed-position, a locking latch being adapted in a first space formed into the rotary handle and being turnable around a second pivot axis between a locked position and a released position, a bottom ring being fixed in relation to the rotary handle, a locking pin also being adapted into the first space in the rotary handle and being movable in a longitudinal direction with the locking latch between a first position and a second position, the locking pin being in the first position positioned at a distance from the bottom ring allowing turning of the rotary handle in relation to the bottom ring, the locking pin protruding in the second position into a first opening in the bottom ring preventing turning of the rotary handle in relation to the bottom ring, a shaft adapter being adapted with a play in a nest formed in the rotary handle and receiving a drive shaft leading from the rotary handle to the electrical switch, the shaft adapter comprising a protrusion having a locking member, a torsion spring extending between the shaft adapter and the rotary handle, wherein the play in the nest permits a restricted rotational movement of the shaft adapter against the spring force of the torsion spring in relation to the rotary handle, wherein the locking pin comprises a groove, wherein the locking member in the protrusion of the shaft adapter settles in the groove thereby locking the locking pin in the first position in a situation in which the torsion moment acting on the rotary handle exceeds the spring force of the torsion spring acting on the shaft adapter in relation to the rotary handle.

2. The rotary handle construction according to claim 1, wherein the locking member in the protrusion in the shaft adapter is formed of the second opening extending through the protrusion, wherein the locking pin is adapted to move through the second opening so that the groove of the locking pin is at the second opening in the first position of the locking pin, wherein an edge of the second opening settles in the groove thereby locking the locking pin in the first position in a situation in which the torsion moment acting on the rotary handle exceeds the spring force acting on the shaft adapter causing a limited rotation of the shaft adapter in relation to the rotary handle.

3. The rotary handle construction according to claim 1, wherein the groove extends around the perimeter of the locking pin.

4. The rotary handle construction according to claim 3, wherein a return spring has been arranged in connection with the locking pin, said return spring returning the locking pin to the first position when the locking latch is released.

5. The rotary handle construction according to claim 4, wherein the return spring is arranged around the locking pin.

6. The rotary handle construction according to claim 1, wherein the torsion spring is formed of a leaf spring.

7. The rotary handle construction according to claim 1, wherein the torsion spring extends in a transverse direction in relation to the first pivot axis.

8. The rotary handle construction according to claim 1, wherein the torsion spring is supported from an end in slots formed in the rotary handle and from its middle portion in a groove in the shaft adapter.

9. The rotary handle construction according to claim 2, wherein the groove extends around the perimeter of the locking pin.

10. The rotary handle construction according to claim 9, wherein a return spring has been arranged in connection with the locking pin, said return spring returning the locking pin to the first position when the locking hatch is released.

11. The rotary handle construction according to claim 10, wherein the return spring is arranged around the locking pin.

12. The rotary handle construction according to claim 1, wherein a return spring has been arranged in connection with the locking pin, said return spring returning the locking pin to the first position when the locking latch is released.

13. The rotary handle construction according to claim 1, wherein the spring force acting on the shaft adapter is achieved with a torsion spring extending between the shaft adapter and the rotary handle.

14. The rotary handle construction according to claim 13, wherein the torsion spring is formed of a leaf spring.

15. The rotary handle construction according to claim 14, wherein the torsion spring extends in a transverse direction in relation to the first pivot axis.

16. The rotary handle construction according to claim 7, wherein the torsion spring is supported from its end in slots formed in the rotary handle and from its middle portion in a groove in the shaft adapter.

17. The rotary hand construction according to claim 1, wherein the spring force acting on the shaft adapter is achieved with a torsion spring extending between the shaft adapter and the rotary handle.

18. The rotary handle construction according to claim 1, wherein a return spring has been arranged in connection with the locking pin, said return spring returning the locking pin to the first position when the locking latch is released.

* * * * *